US008864123B2

(12) United States Patent
Kamiyama et al.

(10) Patent No.: US 8,864,123 B2
(45) Date of Patent: Oct. 21, 2014

(54) IMAGE FORMING APPARATUS

(71) Applicant: Canon Kabushiki Kaisha, Tokyo (JP)

(72) Inventors: Nobuto Kamiyama, Ryugasaki (JP); Keiko Fujita, Kashiwa (JP); Daijiro Kato, Abiko (JP); Kohei Koshida, Toride (JP); Hiroshi Saito, Toride (JP); Yuya Ootsuka, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/910,309

(22) Filed: Jun. 5, 2013

(65) Prior Publication Data

US 2013/0328262 A1 Dec. 12, 2013

(30) Foreign Application Priority Data

Jun. 7, 2012 (JP) ..... 2012-129812

(51) Int. Cl.

| | |
|---|---|
| ***B65H 3/44*** | (2006.01) |
| ***B65H 5/26*** | (2006.01) |
| ***B65H 7/18*** | (2006.01) |
| ***B65H 5/00*** | (2006.01) |

(52) U.S. Cl.

CPC ... *B65H 5/00* (2013.01); *B65H 7/18* (2013.01)
USPC ..... 271/9.09; 271/149; 271/171

(58) Field of Classification Search

CPC ..... B65H 1/02; B65H 3/06; B65H 3/0653; B65H 3/54; B65H 31/20; B65H 2405/20; B65H 2405/21; B65H 2405/214; B65H 2405/22; B65H 2407/21; B65H 3/44; B65H 5/26; B65H 1/025; B65H 2701/1916; B65H 1/30; B65H 2801/21
USPC ..... 271/9.09, 149, 171, 65, 291
See application file for complete search history.

(56) References Cited

U.S. PATENT DOCUMENTS

| | | | | |
|---|---|---|---|---|
| 5,154,411 | A | 10/1992 | Saito et al. | |
| 5,261,651 | A * | 11/1993 | Ishida | 271/3.2 |
| 5,580,042 | A | 12/1996 | Taniguro et al. | |
| 5,620,174 | A | 4/1997 | Taniguro et al. | |
| 5,672,019 | A | 9/1997 | Hiramatsu et al. | |
| 5,725,319 | A | 3/1998 | Saito et al. | |
| 5,918,873 | A | 7/1999 | Saito et al. | |
| 5,927,702 | A * | 7/1999 | Ishii et al. | 271/9.09 |
| 6,168,270 | B1 | 1/2001 | Saikawa et al. | |
| 6,305,682 | B1 | 10/2001 | Saito et al. | |
| 6,939,064 | B2 | 9/2005 | Kawaguchi et al. | |
| 7,034,925 | B2 | 4/2006 | Kamiyama et al. | |
| 7,748,691 | B2 * | 7/2010 | Mizuguchi | 271/9.09 |

(Continued)

FOREIGN PATENT DOCUMENTS

JP 10-268585 A 10/1998

*Primary Examiner* — David H Bollinger
(74) *Attorney, Agent, or Firm* — Fitzpatrick, Cella, Harper & Scinto

(57) ABSTRACT

An image forming apparatus includes a manual feed portion provided on a side surface of a housing that accommodates an image forming portion and having an abutting portion against which a downstream end in a sheet feeding direction of a sheet inserted into a gap between the manual feed portion and the side surface abuts. The manual feed portion also includes a holding portion configured to hold the sheet such that a sheet surface is held along the side surface of the housing in the condition in which the downstream end of the sheet abuts against the abutting portion.

9 Claims, 7 Drawing Sheets

(56) References Cited

U.S. PATENT DOCUMENTS

| | | | | |
|---|---|---|---|---|
| 7,748,697 | B2 | 7/2010 | Fujita et al. | |
| 8,186,674 | B2 | 5/2012 | Fujita | |
| 8,317,187 | B2 * | 11/2012 | Kondo et al. | 271/127 |
| 8,565,663 | B2 * | 10/2013 | Naito et al. | 399/392 |
| 2005/0051942 | A1 * | 3/2005 | Kubo et al. | 271/9.09 |
| 2005/0073085 | A1 * | 4/2005 | Fukada et al. | 271/9.09 |
| 2005/0253323 | A1 * | 11/2005 | Fujita et al. | 271/9.09 |
| 2009/0267283 | A1 * | 10/2009 | Mizuguchi | 271/3.14 |
| 2012/0074636 | A1 * | 3/2012 | Choi | 271/3.18 |
| 2013/0001859 | A1 | 1/2013 | Sugiyama et al. | |

* cited by examiner

IMAGE FORMING APPARATUS

BACKGROUND OF THE INVENTION

1. Field of the Invention

The present invention relates to an image forming apparatus configured to form an image on a sheet, and more specifically to an image forming apparatus including a manual feed portion that feeds a manually inserted sheet to an image forming portion.

2. Description of the Related Art

An image forming apparatus such as a copying machine, a printer, a facsimile, a multifunction machine having their functions, and the like is generally provided with sheet feed cassettes each of which stores a sheet such as a printing sheet. The sheet is supplied from these sheet feed cassettes to an image forming portion.

While there exist various sizes of sheets, each of the above-described sheet feed cassettes stores a bundle of sheets of different size. Accordingly, although the image forming apparatus is provided with the plurality of sheet feed cassettes, it is unable to provide a number of sheet feed cassettes corresponding to all kinds of sizes of sheets handled by the image forming apparatus and hence, it is unable to supply all kinds of sizes of sheets to the image forming apparatus by sheet feed cassettes. In addition, if a sheet inside a sheet feed cassette needs to be replaced every time when a sheet of a different size is fed, the replacement work itself is troublesome. Therefore, an image forming apparatus described in Japanese Patent Application Laid-Open No. H10-268585 for example is configured such that sheets of sizes that are frequently used by a user are stored in sheet cassettes while sheets of sizes that are less frequently used are fed to an image forming portion from a manual feed portion.

The manual feed portion described in Japanese Patent Application Laid-Open No. H10-268585 is provided with a manual feed port on a side surface of the image forming apparatus and with a manual feed tray on the side surface of the image forming apparatus such that the manual feed tray can be opened and closed. The manual feed apparatus is then configured to allow a user to place a sheet on the opened manual feed tray and to feed the sheet placed on the manual feed tray through the manual feed port to the image forming portion.

In the image forming apparatus described in Japanese Patent Application Laid-Open No. H10-268585, however, the manual feed port and the manual feed tray are provided on a lower part of the side surface of the image forming apparatus in order to feed a sheet to be manually inserted from an upstream side in a sheet conveying direction of the image forming portion. Therefore, the user is required to open/close the manual feed tray every time when he/she manually feeds a sheet. There is also a case when the user is required to open/close the manual feed tray and to place a sheet on the manual feed tray in a crouched position. For this reason, there is a demand on eliminating the necessity of opening/closing the manual feed tray and of placing a sheet in a crouching position.

Furthermore, since the manual feed tray that is opened to place a sheet projects from the side surface of the image forming apparatus, a space that allows the manual feed tray to be opened has to be secured upon installation of the image forming apparatus. That is, upon installation of the image forming apparatus, a space that allows the manual feed tray to be opened is needed in addition to a space for placing the image forming apparatus.

SUMMARY OF THE INVENTION

An aspect of the present invention is an image forming apparatus including an image forming portion, a housing configured to accommodate the image forming portion, and a manual feed portion provided on a side surface of the housing and configured to store a manually inserted sheet and to feed the sheet to the image forming portion, the manual feed portion including a feed roller configured to feed the sheet, an abutting portion against which a downstream end in a sheet feeding direction of the sheet that has been manually inserted from above abuts, a holding portion configured to hold the sheet abutting against the abutting portion such that a sheet surface of the sheet is held along the side surface of the housing and a pressing portion configured to press the downstream side in the sheet feeding direction of the sheet held by the holding portion to the feed roller.

DESCRIPTION OF THE EMBODIMENTS

First Exemplary Embodiment

Figure 1:
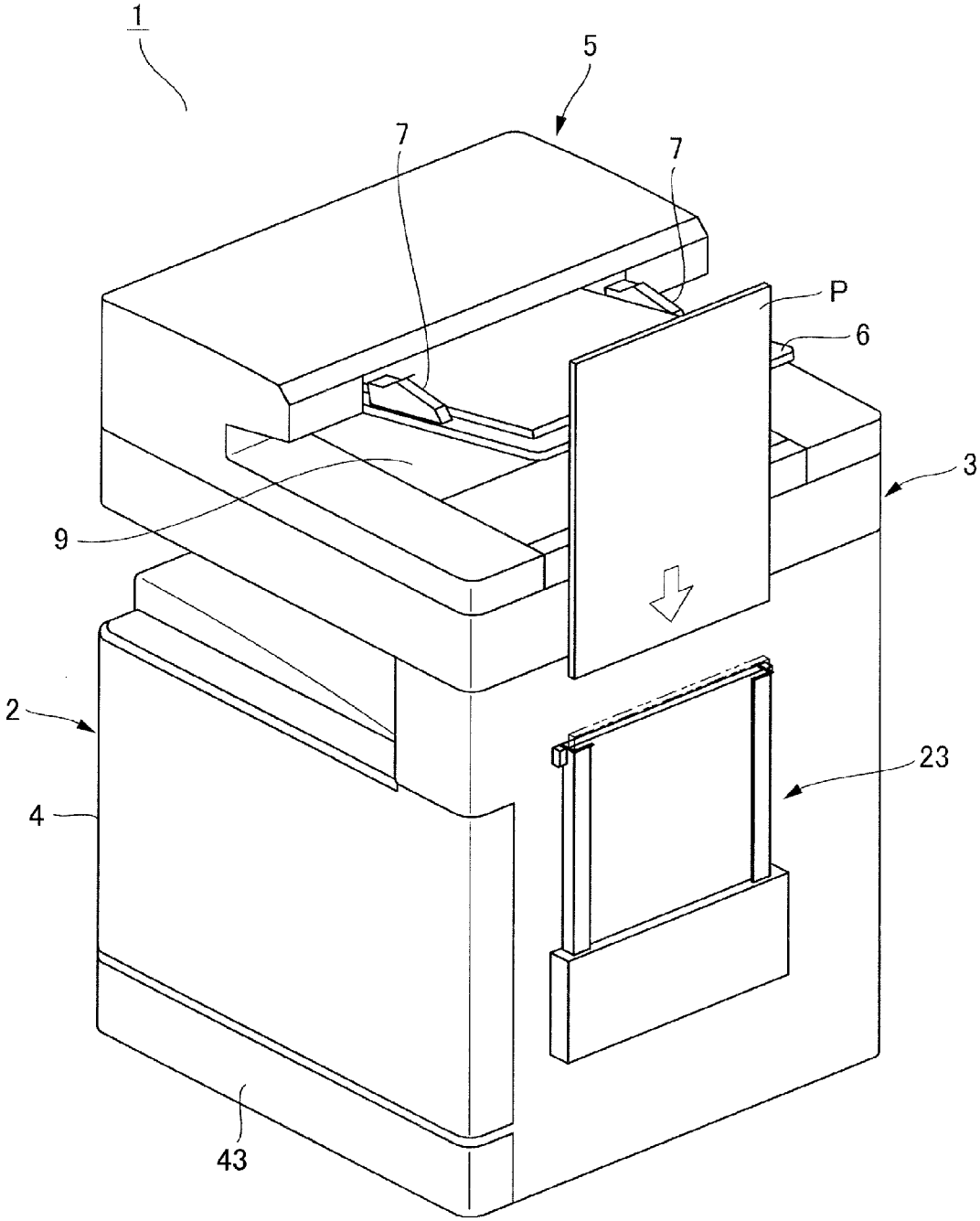
FIG. 1 is a perspective view illustrating a whole digital color multifunction printer according to a first exemplary embodiment.

An image forming apparatus according to a first exemplary embodiment of the present invention will be described below with reference to FIGS. 1 to 4. FIG. 1 illustrates a digital color multifunction printer (referred to simply as a "printer", hereinafter) 1 as an exemplary image forming apparatus of the present embodiment. The printer 1 includes a printer body 2 provided with a housing 4 that houses an image forming portion to be described later and the like, an image reading portion 3 that reads an image to be formed by the printer body 2, and a document feeder 5 that feeds a sheet P such as a document to the image reading portion 3.

Figure 2:
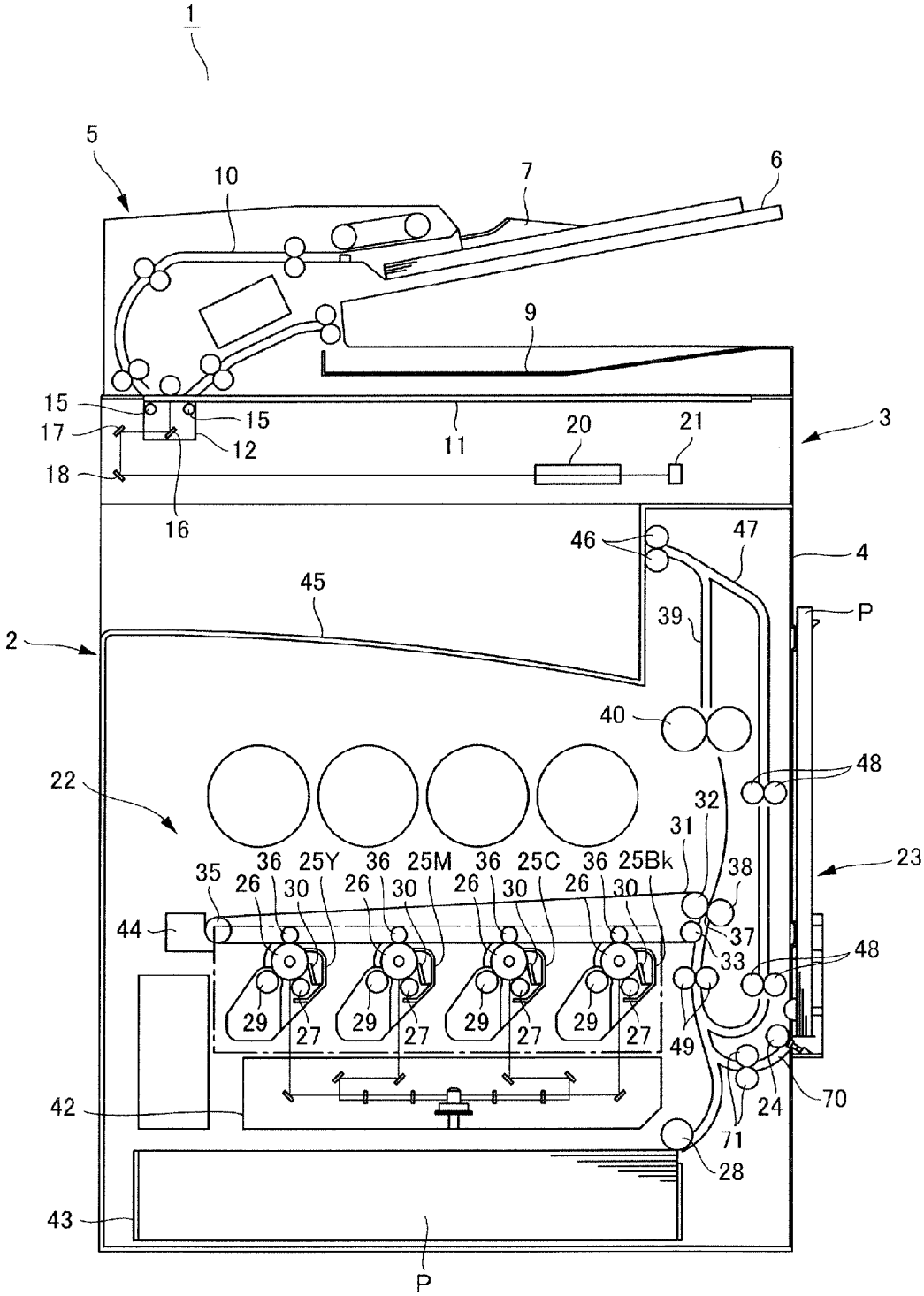
FIG. 2 is a cross sectional view illustrating an internal structure of the digital color multifunction printer according to the first exemplary embodiment.

The document feeder 5 is provided with a sheet stacking tray 6 on which a sheet (including a bundle of sheets) P such as a document is placed. The sheet stacking tray 6 is formed into a rectangular shape and is provided with restricting plates 7 on both sides of the tray that restrict a position of the sheet P in the sheet width direction that is orthogonal to a sheet feeding direction of the placed sheet P. Below the sheet stacking tray 6, there is provided a sheet discharge tray 9 configured to discharge the sheet P whose image has been read by the image reading portion 3. As illustrated in FIG. 2, the a document which has been sent from the sheet stacking tray 6 through a document conveying path 10 and whose image has been read by the image reading portion 3 is discharged to the discharge tray 9.

The image reading portion 3 positioned below the document feeder 5 is provided with a platen glass 11 on which the sheet P is placed and a scanner unit 12 positioned below the platen glass 11 as illustrated in FIG. 2. This scanner unit 12 includes lamps 15 that illuminate the document placed on the platen glass 11 and a mirror 16 that reflects light from the document. In addition, the image reading section 3 is provided with mirrors 17 and 18, a lens 20 that collects light that has been reflected by the mirrors 16, 17 and 18, and a line sensor 21 including a light-receiving element (Charge Coupled Device (CCD), Complementary Metal-Oxide Semiconductor (CMOS), or the like) that converts the collected light into an electrical signal.

As illustrated in FIG. 2, the printer body 2 is provided with an image forming portion 22 that forms the image that has been read by the image reading portion 3 on a sheet P, a feed roller 24 that feeds the sheet P to the image forming portion 22, a manual feed portion 23 that is configured to manually feed a sheet P to the image forming portion 22, and others.

The image forming portion 22 is provided with four detachable process cartridges 25Y, 25M, 25C and 25Bk that contain toners of yellow (Y), magenta (M), cyan (C) and black (Bk), respectively, and form toner images of the respective colors.

Each of the process cartridges 25Y, 25M, 25C and 25Bk is provided with a photosensitive drum 26. This photosensitive drum 26 is provided such that the photosensitive drum 26 is rotated by a driving mechanism (not illustrated). Besides the photosensitive drum 26, each of the process cartridges 25Y, 25M, 25C and 25Bk is provided with a charging roller 27 that uniformly charges the surface of the photosensitive drum 26, developing unit 29 that develops an electrostatic image as a toner image, and a photosensitive drum cleaner 30 that removes toner left on the surface of the photosensitive drum 26.

An endless intermediate transfer belt 31 is positioned above the process cartridges 25Y, 25M, 25C and 25Bk. This intermediate transfer belt 31 is wrapped around a secondary transfer counterface roller 32, a drive roller 33, and a driven roller 35, and is pinched by primary transfer rollers 36 provided at positions opposite the respective photosensitive drums 26 and the photosensitive drums 26.

A secondary transfer roller 38 is provided to face the secondary transfer counter roller 32 around which the intermediate transfer belt 31 is wrapped. The secondary transfer roller 38 is in pressure contact with the secondary transfer counter roller 32 through the intermediate transfer belt 31. A secondary transfer portion 37 is composed of a nip formed by these secondary transfer counter roller 32, the secondary transfer roller 38 and the intermediate transfer belt 31. This secondary transfer portion 37 is provided on a sheet conveying path 39 used to convey the sheet P, and a fixing device 40 that fixes an image on the sheet P is provided on a downstream of the secondary transfer portion 37 on the sheet conveying path 39 in the sheet conveying direction.

An exposure device 42 is provided under the process cartridges 25Y, 25M, 25C and 25Bk. Below this exposure device 42, there is provided a sheet feed cassette 43 that stores the sheet P on which an image is to be formed such that the sheet feed cassette 43 can be drawn in a direction orthogonal to the sheet feeding direction.

The sheet conveying path 39 extends from the sheet feed cassette 43 to a sheet discharge tray 45 that is provided above the image forming portion 22. A pair of reversing rollers 46 that discharges and reverses (switch back) the conveyed sheet is provided on the sheet discharge tray 45 side of the sheet conveying path 39. The sheet conveying path 39 is also connected to a reverse conveying path 47 used to convey the sheet P, that has an image formed on its one surface and that has been reversed, back to the image forming portion 22. This reverse conveying path 47 vertically extends along a side surface of the housing 4, and a plurality of pairs of conveyance rollers 48 that conveys the sheet P is provided on the reverse conveying path 47.

Next, an image forming operation of the printer 1 configured as described above will be described. When a user places a sheet P such as a document on the sheet stacking tray 6 and manipulates to start the image forming operation, the sheet P placed on the sheet stacking tray 6 is fed to the image reading portion 3. An image on the sheet P fed to the image reading portion 3 is read by the scanner unit 12, and the sheet P is discharged to the sheet discharge tray 9 through the document conveying path 10.

Data of the image read by the image reading portion 3 is converted into an electrical signal, which is then transmitted to the exposure device 42. The exposure device 42 to which the electrical signal is transmitted irradiates a laser beam to the surface of each of the photosensitive drums 26 based on the signal. At this time, the photosensitive drums 26 are charged to a predetermined potential in advance, so that the surface thereof is exposed sequentially by being exposed by the laser beam.

The developing units 29 develop electrostatic latent images by causing negatively charged toners to adhere on the photosensitive drums 26. The electrostatic latent images are developed and visualized respectively by color toners of yellow, magenta, cyan and black. Then, a primary transfer bias power source applies a bias of a polarity that is reverse to the charging polarity of the toners to the primary transfer rollers 36. Thus, the toner images on the photosensitive drums 26 are sequentially transferred to and superimposed on the intermediate transfer belt 31. After the transfer, the photosensitive drum cleaners 30 remove tonners remaining on the surfaces of the photosensitive drums 26.

An uppermost sheet P of a bundle of sheets stacked on the sheet feed cassette 43 is fed toward a pair of registration rollers 49 by a pickup roller 28. The fed sheet P is sent to the secondary transfer portion 37 in synchronism with the toner images on the intermediate transfer belt 31 while its skew being corrected by the registration roller pair 49. A secondary transfer bias power source applies a bias of a polarity that is reverse to the charging polarity of the toners to the secondary transfer roller 38, so that the toner images are collectively transferred onto the sheet P.

After the secondary transfer, a transfer cleaner 44 removes secondary transfer residual toner remaining on the intermediate transfer belt 31. The sheet P onto which the toner images have been transferred by the secondary transfer portion 37 is conveyed to the fixing device 40 to fix a color image and is then discharged to the sheet discharge tray 45 by the reversing roller pair 46.

When images are to be formed on both sides of the sheet P, the sheet P on which the image has been fixed by the fixing device 40 is reversed by the reversing roller pair 46 to be conveyed to the reverse conveying path 47. The sheet P conveyed to the reverse conveying path 47 is conveyed to the sheet conveying path 39 by the conveyance roller pairs 48, and then an image is formed again by the image forming portion 22. The sheet P having the images formed on both sides thereof is discharged to the sheet discharge tray 45 by the reversing roller pair 46.

Figure 3:
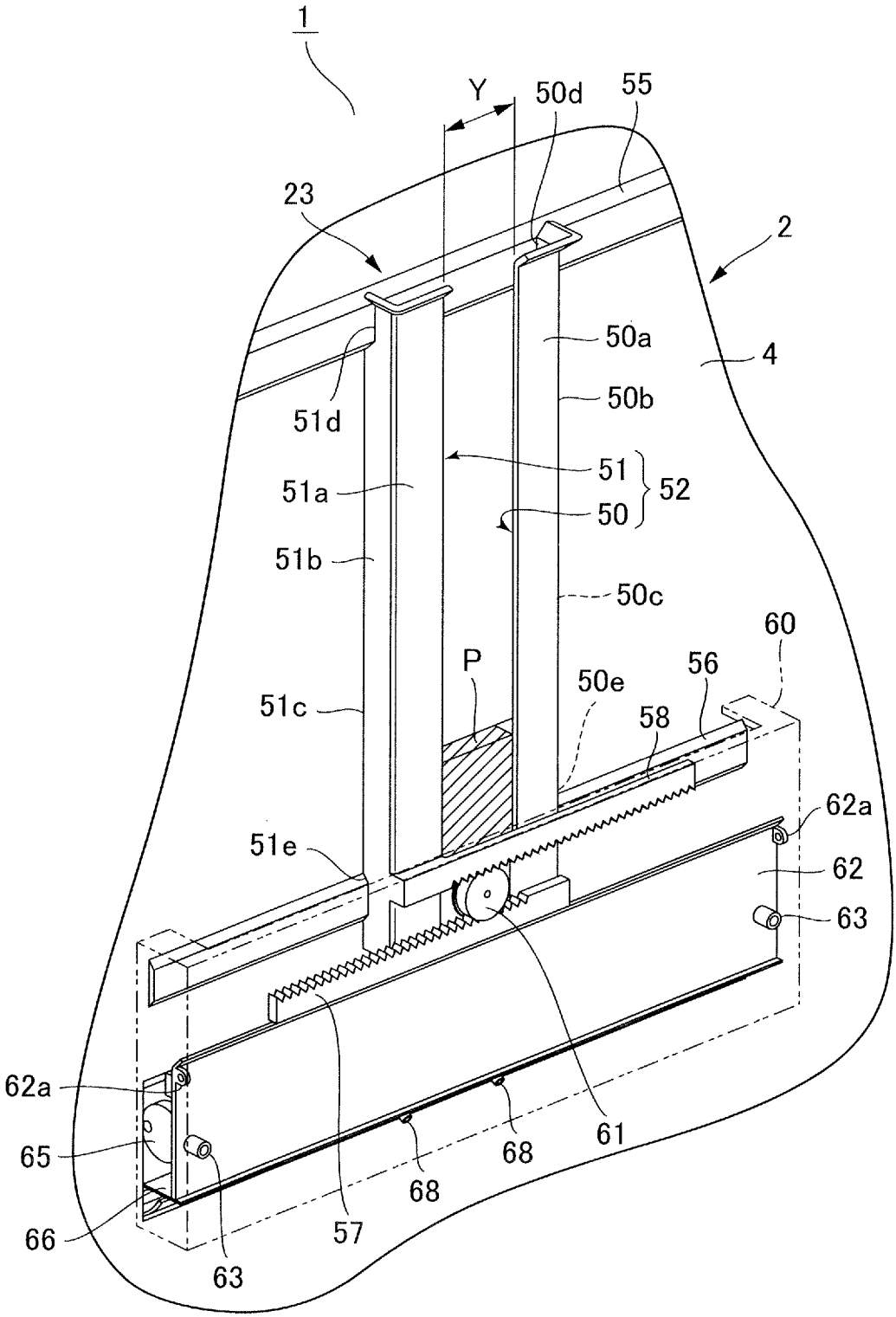
FIG. 3 is a perspective view illustrating a whole manual feed portion according to the first exemplary embodiment.

Next, the manual feed portion 23 used to feed a sheet P manually to the image forming portion 22 will be described. The manual feed portion 23 is provided on a side surface of the housing 4 of the printer body 2 as illustrated in FIG. 3. The manual feed portion 23 is provided with right and left-side restricting plates 50 and 51 i.e., first and second restricting members, such that they face with each other to restrict a position of the sheet P in the sheet width direction. These right and left side restricting plate 50 and 51 are included in a holding section 52 that holds the manually inserted sheet P along the side surface of the housing 4.

The right side restricting plate 50 includes a sheet restricting surface 50*a* that is a first sheet restricting portion configured to restrict the sheet surface of the sheet P, and a sheet width restricting surface 50*b* that is a first sheet width restricting portion configured to restrict the first end of the sheet P in the sheet width direction orthogonal to the sheet feeding direction of the sheet. The right side restricting plate 50 is formed into a L-shape when viewed from the top. The left side restricting plate 51 also has a sheet restricting surface 51*a* that is a second sheet restricting portion configured to restrict the sheet surface of the sheet P and a sheet width restricting surface 51*b* that is a second sheet width restricting portion configured to restrict the second end of the sheet P in the sheet width direction. The left side restricting plate 51 is formed into a L-shape when viewed from the top. The right and left side restricting plates 50 and 51 extend vertically along the side surface of the housing 4 and are configured such that the sheet width restricting surfaces 50*b* and 51*b* are slidably movable in the sheet width direction along the side surface of the housing 4. End surfaces 50*c* and 51*c* of the sheet width restricting surfaces 50*b* and 51*b* may be in sliding contact with the side surface of the housing 4, or may be provided to have a predetermined amount of gap from the side surface of the housing 4.

A width of each of the sheet restricting surfaces 50*a* and 51*a* is set to be small such that the right and left sheet restricting surfaces 50*a* and 51*a* are separated even when a sheet P having a minimum width is restricted by the right and left side restricting plates 50 and 51.

Upper and lower ends of the sheet width restricting surfaces 50*b* and 51*b* are cut away, respectively, as illustrated in FIG. 3. These cutaway portions 50*d*, 50*e*, 51*d* and 51*e* fit with a projecting portion 55 provided on an upper part of the side surface of the housing 4 (referred to as a "first projection portion" hereinafter) and a projecting portion 56 provided on a lower part of the side surface (referred to as a "second projection portion" hereinafter) 56.

Figure 4:
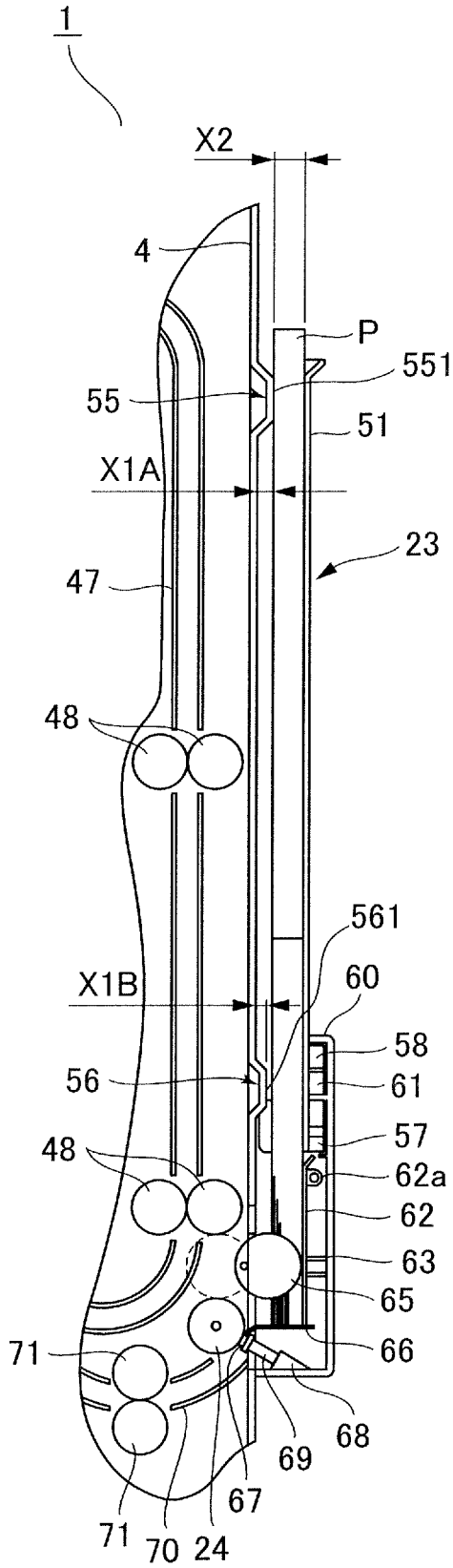
FIG. 4 is a cross sectional view illustrating a structure of the manual feed portion according to the first exemplary embodiment.

The first and second projection portions 55 and 56 project from the side surface of the housing 4 toward the sheet restricting surfaces 50*a* and 51*a* (the sheet restricting portion side) by a predetermined extent of projection (see FIG. 4). The first and second projection portions 55 and 56 extend in the sheet width direction over the sheet width restricting surface 50*b* of the right side restricting plate 50 and the sheet width restricting surface 51*b* of the left side restricting plate 51. The extents of projections of these first and second projection portions 55 and 56 are set such that the projection ends (peaks) 551 and 561 on a sheet restricting surface side i.e. ends being close to the sheet regulating portion, overlap at least with a part of each of the end surfaces 50*c* and 51*c* on a housing side of the right and left side restricting plates 50 and 51 in the projecting direction i.e. ends being close to the sheet regulating portion.

More specifically, the first projection portion 55 located at a sheet inserting port projects toward the sheet restricting surfaces 50*a* and 51*a* by the extent of projection X1A, and projects slightly more than the lower second projection portion 56 whose extent of projection is X1B (X1A>X1B). With this configuration, it is possible to prevent the sheet P from entering into a gap between the side surface of the housing 4 and the end surfaces 50*c* and 51*c* of the sheet width restricting surface 50*b* and 51*b*. In addition, the first projection portion 55 can restrict an insertion width X2 that is a thickness (maximum number of sheets) of a sheet bundle which can be manually inserted and stored between the side surface of the housing 4 and the sheet restricting surfaces 50*a* and 51*a* (see FIG. 4).

Provided respectively on the lower end sides of the right and left side restricting plates 50 and 51 are plate-like rack gears 57 and 58 extending in the sheet width direction. The rack gears 57 and 58 are covered with a manual feed cover 60 formed into a rectangular shape. Provided rotatably within the manual feed cover 60 is a pinion gear 61 meshing with the rack gears 57 and 58.

Provided also within the manual feed cover 60 is a middle plate 62 that is a pressing member configured to press a downstream side in the sheet feeding direction of the manually inserted sheet P to the feed roller 24. This middle plate 62 is turnable as its turning support portions 62*a* provided at an upstream end in the sheet feeding direction are supported by the manual feed cover 60. Disposed between the middle plate 62 and the manual feed cover 60 are middle plate pressuring springs 63 that are biasing members. The mille plate 62 is biased by a biasing force of the middle plate pressuring springs 63 such that its downstream side in the sheet feeding direction moves toward the housing 4.

Provided rotatably on both right and left end sides of the middle plate 62 so as to face the middle plate 62 are eccentric cams 65. Provided below the eccentric cams 65 is an abutting plate 66 that is an abutting portion against which the downstream end in the sheet feeding direction of the manually inserted sheet P abuts.

It is noted that within the housing 4, there is provided a manual feeding path 70 configured to convey the sheet P manually inserted to the manual feed portion 23 to the image forming portion 22 and merges with the sheet conveying path 39 (see FIG. 2). Along the manual feeding path 70, there are rotatably provided the feed roller 24 that feeds the manually inserted sheet P and a pair of drawing rollers 71 that conveys the sheet P fed by the feed roller 24 as illustrated in FIG. 4. Disposed opposite to the feed roller 24 is a separation pad 67. This separation pad 67 is supported by a supporting member 68 and is pressed to the feed roller 24 by a pressing force of a pressure spring 69 provided on the supporting member 68. The pressure contact of the separation pad 67 with the feed roller 24 forms a nip where a sheet P is separated one by one from the bundle of sheets stored in the manual feed portion 23.

Next, a feeding operation of a sheet manually stored in the manual feed portion 23 of the printer 1 configured as described above will be described. In order to feed a sheet P from the manual feed portion 23, a user manually inserts the sheet P from above between the side surface of the housing 4 and the right and left side restricting plates 50 and 51.

At this time, the right and left side restricting plates 50 and 51 are slid to adjust a distance between the right and left sheet width restricting surfaces 50*b* and 51*b* to the width (size) of the sheet P. When at least one of the right and left side restricting plates 50 and 51 is slid, one of the rack gears 57 and 58 moves and along with the movement of the one of the rack gears 57 and 58, the pinion gear 61 rotates. Along with the rotation of the pinion gear 61, the other one of the rack gears 57 and 58 moves and the other restricting plate moves.

The downstream end in the sheet feeding direction of the inserted sheet P abuts against the abutting plate 66. The sheet surface of the sheet P is restricted by the sheet restricting surfaces 50*a* and 51*a*, and the widthwise both ends of the sheet P are restricted by the sheet width restricting surfaces 50*b* and 51*b*, respectively, so that the sheet P is held upright such that its sheet surface is held along the side surface of the housing 4.

When the right and left side restricting plates 50 and 51 hold the sheet P, the sheet restricting surfaces 50*a* and 51*a* are separated. That is, even when the right and left side restricting plates 50 and 51 hold a sheet P having a minimum width as illustrated in FIG. 3, there exists a gap Y through which the sheet surface and an upstream part in the sheet feeding direction of the sheet P are exposed.

Along with the rotation of the eccentric cam 65 (moved to a position indicated by a broken line, see FIG. 4), the downstream side in the sheet feed direction of the held sheet P is pressed against the feed roller 24 by the middle plate 62 turned by a biasing force of a middle plate pressuring spring 63. From the sheet (s) P that is pressed against the feed roller 24, one sheet that is closest to the side surface of the housing 4 is separated and fed to the manual feeding path 70 through a feed port (not illustrated) by the feed roller 24 rotated by a driving mechanism (not illustrated) and the separation pad 67.

When the downstream end in the sheet feeding direction of the sheet P that has been fed to the manual feeding path 70 reaches the drawing roller pair 71 positioned along the manual feeding path 70, the sheet P is conveyed to the image forming portion 22 by the drawing roller pair 71. After feeding the sheet P, along with the rotation of the eccentric cam 65, the downstream end in the sheet feeding direction of the middle plate 62 moves in a direction away from the side surface of the housing 4, and the manual feed portion 23 is ready to feed another sheet.

As described above, the right and left side restricting plates 50 and 51 restrict the sheet surface and the widthwise position of the manually inserted sheet P, so that it is possible to hold the sheet P such that more than half of the sheet surface from the downstream end to the upstream side in the sheet feeding direction of the sheet P is held along the side surface of the housing 4. Therefore, when the user manually feeds the sheet P, it is unnecessary to open/close the manual feed tray, and the user can insert the sheet P from the above side of the side surface of the housing 4 and can manually insert a sheet in the standing position. Thus, the operability of the printer 1 can be improved. In addition, since a sheet is manually inserted and held in the standing position, there is no need to secure a space for opening the manual feed tray, and a space for installing the printer 1 can be saved.

Since the feed roller 24 that feeds a sheet P is provided within the printer body 2 (inside of the side surface of the housing 4), it is possible to suppress the downstream end in the sheet feeding direction of the sheet P from being caught by the surface of the feed roller 24 when the sheet P abuts against the abutting plate 66. Thus, it is possible to prevent the downstream end in the sheet feeding direction of the sheet P from being turned up and the sheet P from being set improperly in inserting the sheet P into the manual feed portion 23.

The abutting plate 66 is provided on a lower part of the side surface of the housing 4 that is positioned on the downstream side in the insertion direction of the sheet P, so that the downstream end in the sheet feeding direction of the sheet P abuts reliably against the abutting plate 66 and the sheet P can be held even if a user releases the sheet P upon manual feed. This makes it possible to suppress jamming caused by improper setting of the sheet P and defective conveyance caused by skew of the sheet P.

Since the rack gears 57 and 58 provided on the right and left side restricting plates 50 and 51 mesh with the pinion gear 61, one of the right and left side restricting plates 50 and 51 can be slid in conjunction with the slide of the other in accordance with a sheet P. This makes it possible to align a widthwise center of the sheet P with a center in forming an image by the image forming portion 22 in restricting the sheet P by the right and left side restricting plates 50 and 51.

At least the widthwise ends of a manually inserted sheet P located around the first and second projection portions 55 and 56 protrude toward the sheet restricting surfaces 50*a* and 51*a* due to the first and second projection portions 55 and 56 which project by the predetermined amount of projection when the manually inserted sheet P abuts against the abutting plate 66. Therefore, it is possible to reliably restrict the widthwise ends of the sheet P around the first and second projection portions 55 and 56 by the right and left sheet width restricting surfaces 50*b* and 51*b*. This makes it possible to prevent the sheet P from entering into the gap between the side surface of the housing 4 and the end surfaces 50*c* and 51*c* of the sheet width restricting surfaces 50*b* and 51*b* in manually feeding the sheet P into the manual feed portion 23. In addition, this makes it possible to keep the sheet P in a proper attitude, to suppress the sheet P from being improperly fed due to defective conveyance such as jamming and skew, and to prevent bend or breakage of the sheet.

The first projection portion 55 restricts the insertion width X2 that allows a sheet (s) P to be manually inserted between the side surface of the housing 4 and the sheet restricting surfaces 50*a* and 51*a* of the right and left side restricting plates 50 and 51. This makes it possible to abut the sheet P against the abutting plate 66 and to hold the sheet P without causing the downstream end in the sheet feeding direction of the sheet P to be caught by the second projection portion 56 upon insertion of the sheet P.

When the right and left side restricting plates 50 and 51 restrict a sheet P, the respective sheet restricting surfaces 50*a* and 51*a* are separated, so that there is formed the gap Y through which the sheet surface of the sheet P and the upstream part of the side surface in the sheet feeding direction of the housing 4 are exposed. This arrangement makes it possible for the user to easily hold and take out the held sheet P through the gap Y, so that the user can easily replace the sheets having different sizes and types.

It is noted that the image forming apparatus of the present embodiment is configured such that the sheet P is held along the outside of the side surface of the housing 4, the configuration is not limited only to that. For example, the right and left side restricting plates 50 and 51 may be provided inside the side surface of the housing 4, and the sheet surface of the sheet P may be held along the inside of the side surface of the housing 4.

Still further the image forming apparatus of the present embodiment is configured to feed the sheet P in accordance to a so-called guide center, the configuration is not limited only to that. For example, the present embodiment may be configured such that a sheet P may be conveyed in accordance to a so-called one-side guide, in which either one of the right and left side restricting plates 50 and 51 is fixed and the other one is made slidable.

Still further, although the image forming apparatus of the present embodiment is configured such that the middle plate 62 presses the downstream side in the sheet feeding direction of the sheet P to the feed roller 24 whereby the sheet P is separately fed, the configuration is not limited only to that.

For example, the image forming apparatus may be configured such that a pickup roller is provided to feed the sheet P to the feed roller 24, and a separation member such as the separation pad 67, a retard roller, a separation roller or the like (not illustrated) may be brought into pressure contact with the feed roller 24, whereby the sheet P may be separated and fed.

The retard roller is in pressure contact with the feed roller 24, and is configured to rotate in the direction opposite from the direction of feeding the sheet P through a torque limiter. The separation roller is in pressure contact with the feed roller 24, is connected with the torque limiter, and is configured to rotate idly when a torque exceeds a preset value. Then, if the number of the sheets P taken out is one, the retard roller and the separation roller rotate together with the feed roller 24 and if the number of the sheets is two or more, the retard roller rotates backward and the separation roller stops rotating to prevent the sheets P from being fed doubly.

Second Exemplary Embodiment

Next, a printer 1A according to a second exemplary embodiment of the present invention will be described with reference to FIG. 5. The configuration of the printer 1A is different from that of the printer 1 of the first exemplary embodiment described above in that a manual feeding path 75 merges with a reverse conveying path 47 and that a feed roller 73 composes a conveyance roller pair 72 and 73. The printer 1A is also different from the printer 1 in that the feed roller 73 is configured to allow a reversed sheet P to be conveyed and a manually inserted sheet P to be also fed. While differences between the printer 1A of the second exemplary embodiment and the printer 1 of the first exemplary embodiment described above will be described below, the same or corresponding parts thereof with the printer 1 will be denoted by same reference numerals and their explanation will be omitted here.

Figure 5:
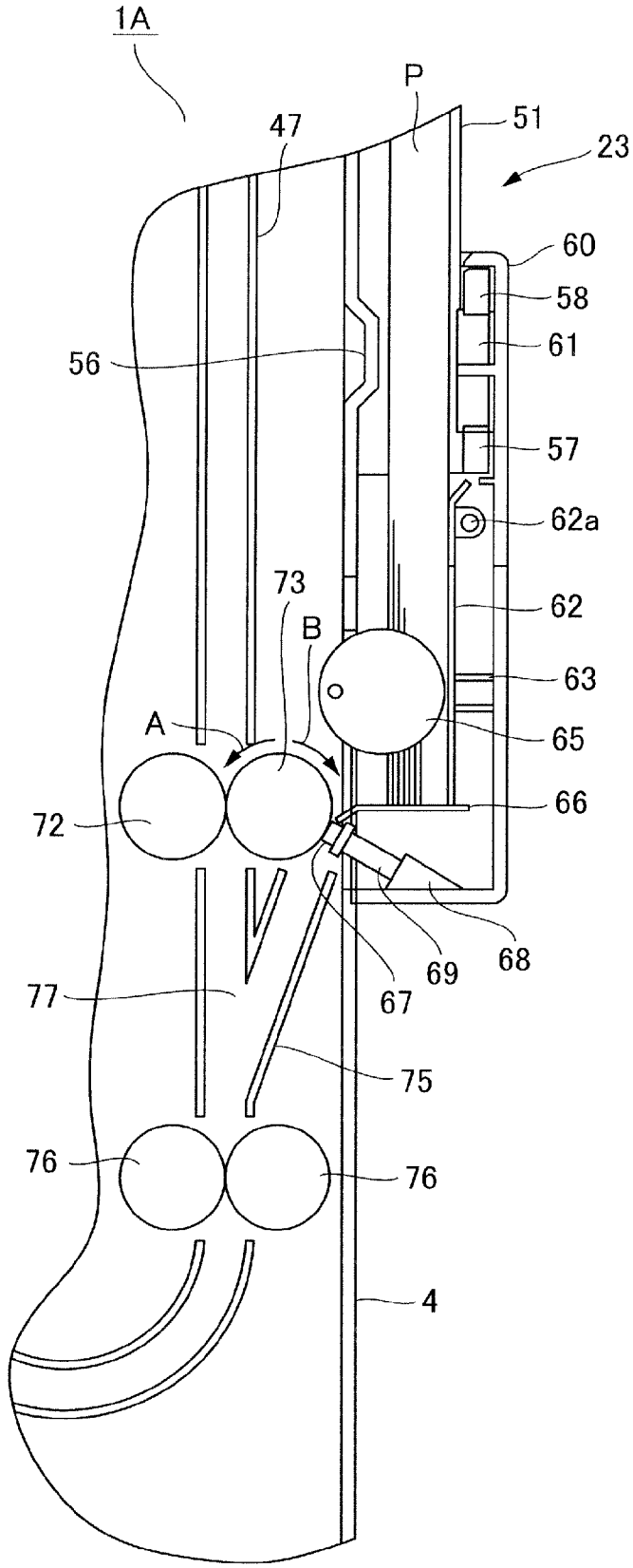
FIG. 5 is an enlarged cross sectional view illustrating the structure of a manual feed portion according to a second exemplary embodiment.

The manual feeding path 75 of the printer 1A merges with the reverse conveying path 47 that extends along the housing 4 as illustrated in FIG. 5. The reverse conveying path 47 is provided with a merge portion 77 formed into a Y-shape when viewed from the side. Provided along this reverse conveying path 47 and on the upstream side in the sheet conveying direction from the merge portion 77 are the conveyance roller pair (referred to as a "first conveyance roller pair" hereinafter) 72 and 73. The first conveyance roller pair 72 and 73 includes the feed roller 73 as described above. The feed roller 73 is configured to rotate switchably in forward and backward directions and is positioned between the reverse conveying path 47 and the sheet feeding path. Provided along the reverse conveying path 47 and on the downstream side in the sheet conveying direction from the merge portion 77 is a conveyance roller pair (referred to as a "second conveyance roller pair" hereinafter) 76.

Next, a manual feed operation of the printer 1A configured as described above will be described. Similarly to the first exemplary embodiment, a user manually inserts a sheet P between the side surface of the housing 4 and the right and left side restricting plates 50 and 51. After abutting the downstream end in the sheet feeding direction of the sheet P against the abutting plate 66 and holding the sheet P, the user manipulates to start feeding the sheet P. With the start of feed, the sheet P abutting against the abutting plate 66 is pressed to the feed roller 73 by the middle plate 62, and fed to the manual feeding path 75 through a feed port by the feed roller 73 that rotates in a direction of an arrow B by a driving mechanism (not illustrated).

The fed sheet P is fed to the reverse conveying path 47 from the merge portion 77 as illustrated in FIG. 5, and conveyed to the image forming portion 22 by the second conveyance roller pair 76. In a case when the feed roller 73 conveys the sheet P reversed by the switchback to the image forming portion 22, the rotation direction of the feed roller 73 is switched in a direction of an arrow A, and the feed roller 73 serves as a part of the first conveyance roller pair 72 and 73 to convey the sheet P to the image forming portion 22.

The sheet P fed by the feed roller 73 comes into the reverse conveying path 47 as described above, so that it is possible to reduce a bend of the manual feeding path 75 from the feed roller 73 up to the second conveyance roller pair 76. Therefore, it is possible to feed a highly rigid sheet P from the manual feed portion 23 and to feed various types of manually inserted sheets P.

Since the feed roller 73 is switchable between the forward and backward rotations and is configured as the part of the first conveyance roller pair 72 and 73 that conveys a reversed sheet, it is possible to use a drive source commonly as what rotationally drives both the feed roller 73 and the first conveyance roller pair 72 and 73. This makes it possible to save the production costs of the printer 1A because there is no need to provide drive sources for the feed roller and the first conveyance roller pair individually.

In addition, the second conveyance roller pair 76 is configured also as a drawing roller pair that conveys a fed sheet P to the image forming portion 22, so that it is possible to cut the production cost of the printer 1A because no other drawing roller need be provided.

It is note that the separation pad 67 is configured such that the separation pad 67 can retract from a position where the separation pad 67 is in pressure contact with the feed roller 73 in conjunction with conveyance of the reversed sheet P (when the feed roller 73 rotates in the direction of the arrow A), e.g. by supporting the separation pad 67 movably by an actuator or the like. With this configuration, it is possible to reduce a pressure contact force from the separation pad 67 to the feed roller 73 upon conveying the sheet P. This makes it possible to reduce a load for driving the feed roller 73 upon reversely conveying the sheet P.

Third Exemplary Embodiment

Next, a printer 1B according to a third exemplary embodiment of the present invention will be described with reference to FIGS. 6 and 7. The configuration of the printer 1B is different from that of the printers 1 and 1A of the first and second embodiments described above in that sheet width restricting surfaces 80*b* and 81*b* are provided with turn-back restricting surfaces 80*c* and 81*c*, and that the downstream end in the sheet feeding direction of a long sheet P is located below the upstream end thereof when the sheet P is manually inserted while being turned back. The differences between the printer 1B of the third exemplary embodiment and the printers 1 and 1A of the first and second embodiments will be described below, and the same or corresponding parts with those of the above-described printers 1 and 1A will be denoted by the same reference numerals and their explanation will be omitted here.

Figure 6:
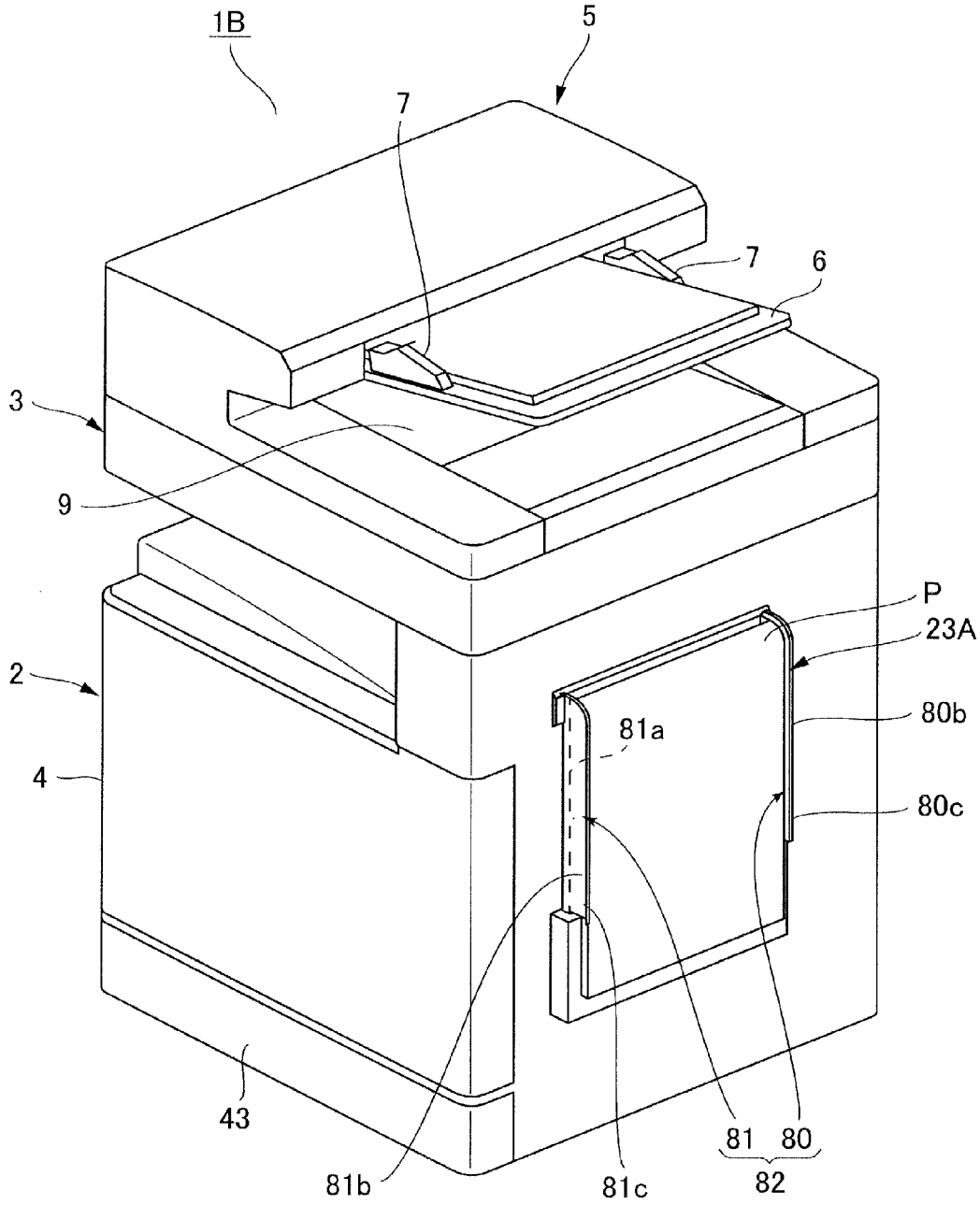
FIG. 6 is a perspective view illustrating a whole digital color multifunction printer according to a third exemplary embodiment.
Figure 7:
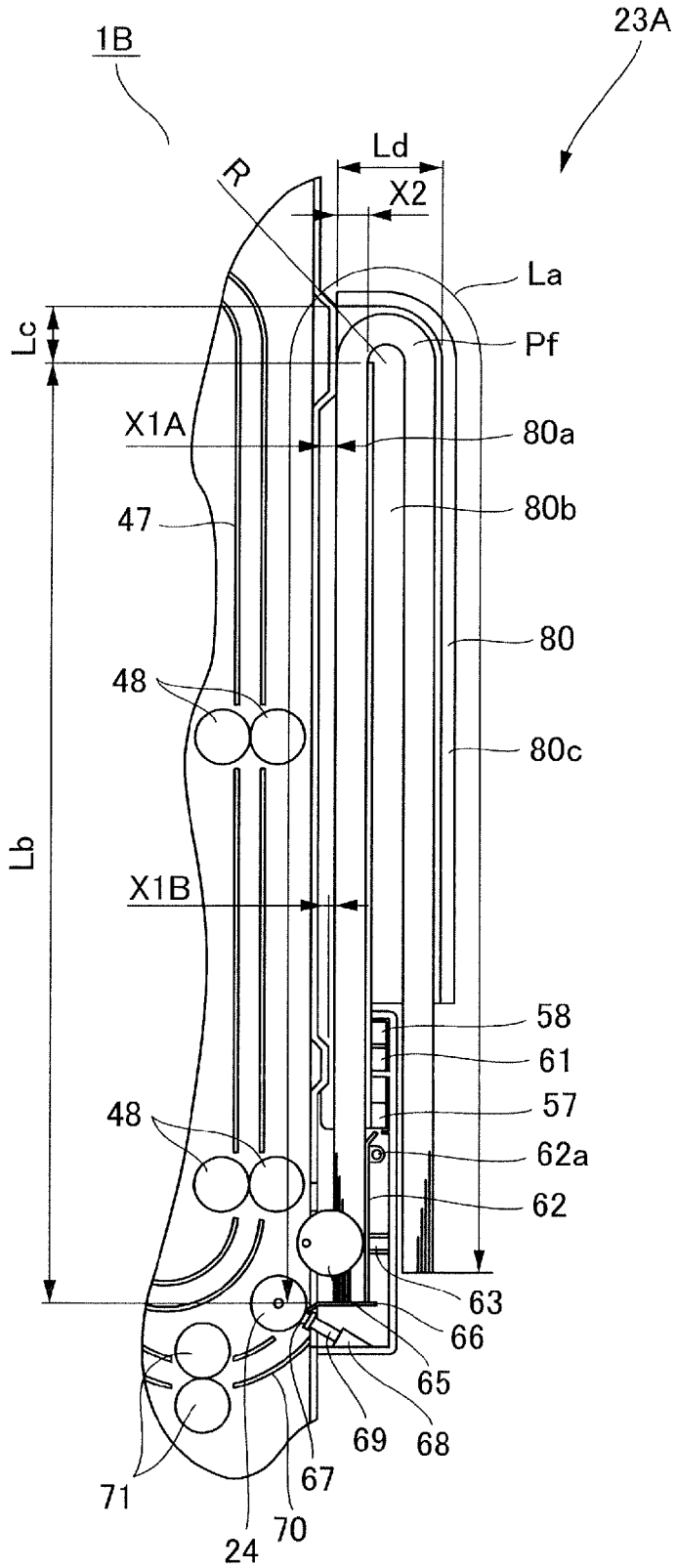
FIG. 7 is a cross sectional view illustrating a structure of a manual feed portion according to the third exemplary embodiment.

A manual feed portion 23A of the printer 1B has a holding portion 82 including right and left side restricting plates 80 and 81 as illustrated in FIG. 6. The right side restricting plate 80 is provided with a sheet restricting surface 80*a* that restricts the sheet surface of the sheet P and a sheet width restricting surface 80*b* that restricts the widthwise position of the sheet P. In the same manner, the left side restricting plate

81 is provided with a sheet restricting surface 81*a* and a sheet width restricting surface 81*b*. A bundle of long sheets P is set such that it is turned back at the upper end of the sheet restricting surfaces that restrict the sheet surface of the right and left side restricting plates 80 and 81.

The sheet P is turned back so that the upstream side in the sheet feeding direction of the sheet P hangs down. The sheet width restricting surfaces 80*b* and 81*b* are provided with the turn-back restricting surfaces 80*c* and 81*c* that are turned-back restricting portions configured to restrict widthwise positions of the turned back part Pf and the hanged parts of the manually inserted sheet P. The turn-back restricting surfaces 80*c* and 81*c* are formed integrally with the sheet width restricting surfaces 80*b* and 81*b*, and extend toward the outside from the sheet width restricting surfaces 80*b* and 81*b* (in a direction away from the side surface of the housing 4).

Here, a maximum length in the sheet feeding direction of the sheet P that can be fed to the image forming portion 22 is defined as La. As illustrated in FIG. 7, the right and left sheet restricting surfaces 80*a* and 81*a* are configured such that their height Lb from the abutting plate 66 to their upper ends is longer than La/2. That is, the restricting surfaces are configured such that when a sheet P is manually inserted into the manual feed portion 23A while being turned back, the downstream end in the sheet feeding direction of the sheet P is located below the upstream end in the sheet feeding direction of the sheet P. With this configuration, the center of gravity of the bundle of long sheets thus set is positioned between the side surface of the housing 4 and the sheet restricting surfaces that restrict the sheet surface.

Next, a manual feed operation of the printer 1B configured as described above will be described. Similarly to the first and second embodiments, a user inserts a sheet (long sheet) P along a gap between the side surface of the housing 4 and the right and left side restricting plates 80 and 81. Then, the downstream end in the sheet feeding direction of the sheet P abuts against the abutting plate 66. Upon abutment of the sheet, the upstream side of the sheet P projects out of the right and left side restricting plate 80 and 81, so that this projecting part is turned back. Since the height Lb of the sheet restricting surface 81*a* satisfies the relationship: Lb>La/2, the downstream end of the sheet P is located below the upstream end of the turned-back sheet when the sheet P is turned back.

Thus, the sheet P is held such that the turned back part Pf and the hang down part hanging down on the upstream side in the sheet feeding direction of the sheet are restricted in the sheet width direction by the turn-back restricting surfaces 80*c* and 81*c*. Then, with a manipulation for starting to feed the sheet, the feed roller 24 feeds the sheet P one by one in the same manner with the above-described printers 1 and 1A.

As described above, when the sheet P is held while being turned back, the downstream end of the sheet P is located below the upstream end thereof. Therefore, the downstream end of the sheet P reliably abuts against the abutting plate 66 by its own weight. Accordingly, this configuration makes it possible to suppress an occurrence of jam, skew, or the like due to improper setting and to prevent bend, breakage, and stain of the sheet P otherwise caused by falling of the upstream end of the sheet P from the manual feed portion 23A.

Since the turned back part Pf and the hanged down part of the sheet P are restricted widthwise by the turn-back restricting surfaces 80*c* and 81*c*, it is possible to prevent the sheet P from skewing and to improve position accuracy of an image to be formed on the sheet P.

It is noted that a maximum bending radius at the turned back portion Pf is assumed to be R when a sheet P which can be fed to the image forming portion 22 is manually inserted while being turned back in consideration of type, rigidity, thickness, size, fiber orientation direction, moisture content, use environment, curling condition, and the like of the sheet P. In addition, as illustrated in FIG. 7, a height of parts of the turn-back restricting surfaces 80*c* and 81*c* that restrict the widthwise position of the turned back portion Pf is defined as Lc, and a length (width) of parts of the restricting surfaces 80*c* and 81*c* that restrict the sheet widthwise position of the turned back portion Pf is defined as Ld. Then, Lc and Ld are set respectively such that they satisfy the following relationships: Lc>R and Ld>2R. That is, the turn-back restricting surfaces 80*c* and 81*c* are configured to make a space in which the maximum bending radius R can fit. This configuration is preferable because the manually inserted sheet P can be reliably held, and skew can be reduced.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-129812, filed on Jun. 7, 2012 which is hereby incorporated by reference herein in its entirety.

What is claimed is:

1. An image forming apparatus comprising:

an image forming portion;

a housing configured to accommodate the image forming portion; and a manual feed portion provided on a side surface of the housing and configured to store a manually inserted sheet and to feed the sheet to the image forming portion, the manual feed portion comprising:

a feed roller configured to feed the sheet;

an abutting portion against which a downstream end in a sheet feeding direction of the sheet that has been manually inserted from above abuts;

a holding portion configured to hold the sheet abutting against the abutting portion upright such that a sheet surface of the sheet is held along the side surface, which is formed of a substantially vertical surface, of the housing; and a pressing portion configured to press the downstream side in the sheet feeding direction of the sheet held by the holding portion to the feed roller.

2. The image forming apparatus according to claim 1, wherein the holding portion includes:

a first restricting member having a first sheet restricting portion configured to restrict the sheet surface of the manually inserted sheet and a first sheet width restricting portion configured to restrict a first end of the sheet in a sheet width direction orthogonal to the sheet feeding direction of the sheet; and a second restricting member disposed to face the first restricting member in the sheet width direction and having a second sheet restricting portion configured to restrict the sheet surface of the manually inserted sheet and a second sheet width restricting portion configured to restrict a second end of the sheet in the sheet width direction; and at least one of the first restricting member and the second restricting member is configured to be movable in the sheet width direction along the side surface of the housing.

3. The image forming apparatus according to claim 2, further comprising a projection portion projecting from the side surface of the housing toward a sheet restricting portion side such that projection end of the projection portion on the sheet restricting portion side overlaps at least with a part of each of end surfaces on a housing side of the first and second sheet width restricting portions in a projecting direction of the projection portion.

4. The image forming apparatus according to claim 2, wherein the projection portion extends in the sheet width direction over the first and second restricting members.

5. The image forming apparatus according to claim 2, wherein the first and second sheet restricting members are configured such that the first and second sheet width restricting portions restrict the first and second widthwise ends of the manually inserted sheet in a condition in which the first and second sheet restricting portions are separated.

6. The image forming apparatus according to claim 2, wherein the first and second restricting members are configured to restrict the sheet such that the upstream side in the sheet feeding direction of the manually inserted sheet is turned back and hangs down in a condition in which the sheet abuts against the abutting portion, and such that the downstream end of the sheet is located below an upstream end of the sheet.

7. The image forming apparatus according to claim 6, wherein each of the first and second restricting members includes a turn-back restricting portion configured to restrict widthwise at least a turned-back part of the sheet that has been turned back.

8. The image forming apparatus according to claim 1, wherein the holding portion is formed into a shape that holds the sheet that abuts against the abutting portion such that more than half of the sheet surface from the downstream end in the sheet feeding direction to the upstream side is held along the side surface of the housing.

9. The image forming apparatus according to claim 1, further comprising:

a reverse conveying path configured to convey a reversed sheet on which an image has been formed on one surface thereof by the image forming portion; and a manual feeding path configured to feed the manually inserted sheet, the manual feeding path merging with the reverse conveying path at a merge portion;

wherein the feed roller is positioned on the upstream side in the reverse conveying path of the merge portion and the manual feeding path and is positioned between the reverse conveying path and the manual feeding path, and is configured such that the feed roller is capable of conveying the reversed sheet and of feeding the manually inserted sheet.

* * * * *